US008961093B2

(12) United States Patent
Springett et al.

(10) Patent No.: US 8,961,093 B2
(45) Date of Patent: Feb. 24, 2015

(54) DRILLING RIG PIPE TRANSFER SYSTEMS AND METHODS

(75) Inventors: Frank Benjamin Springett, Spring, TX (US); Dean Allen Bennett, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 426 days.

(21) Appl. No.: 12/842,317

(22) Filed: Jul. 23, 2010

(65) Prior Publication Data

US 2012/0020758 A1 Jan. 26, 2012

(51) Int. Cl.

| | |
|---|---|
| ***E21B 19/00*** | (2006.01) |
| ***B25J 15/00*** | (2006.01) |
| ***E21B 19/14*** | (2006.01) |
| ***E21B 19/20*** | (2006.01) |

(52) U.S. Cl.

CPC ..... *E21B 19/14* (2013.01); *E21B 19/20* (2013.01)

USPC ..... 414/22.63; 414/22.65; 414/22.68; 211/70.4; 294/106; 294/198

(58) Field of Classification Search

USPC ..... 414/22.51–22.71; 294/198, 202, 294/67.3–67.33, 86.3–86.34

See application file for complete search history.

(56) References Cited

U.S. PATENT DOCUMENTS

| | | | | |
|---|---|---|---|---|
| 3,312,294 | A * | 4/1967 | Wilson | 173/164 |
| RE26,284 | E * | 10/1967 | O'Neill et al. | 175/57 |
| 3,658,138 | A | 4/1972 | Gosselin | 173/1 |
| 4,013,178 | A | 3/1977 | Brown et al. | 214/2.5 |
| 4,042,123 | A | 8/1977 | Sheldon et al. | 214/2.5 |
| 4,044,895 | A | 8/1977 | Adair | 214/2.5 |
| 4,077,525 | A * | 3/1978 | Callegari et al. | 414/22.63 |
| 4,128,135 | A | 12/1978 | Mitchhart et al. | 175/52 |
| 4,269,554 | A * | 5/1981 | Jackson | 414/22.63 |
| 4,274,777 | A * | 6/1981 | Scaggs | 414/22.63 |
| 4,274,778 | A | 6/1981 | Putnam et al. | 414/22 |
| 4,304,433 | A * | 12/1981 | Langowski | 294/106 |
| 4,345,864 | A * | 8/1982 | Smith et al. | 414/22.63 |
| 4,440,536 | A * | 4/1984 | Scaggs | 414/22.51 |
| 4,462,733 | A | 7/1984 | Langowski et al. | 414/22 |
| 4,531,875 | A * | 7/1985 | Krueger | 414/22.68 |
| 4,621,974 | A * | 11/1986 | Krueger | 414/800 |
| 4,725,179 | A | 2/1988 | Woolslayer et al. | 414/22 |
| 4,765,401 | A | 8/1988 | Boyadjieff | 166/77.5 |
| 4,850,439 | A | 7/1989 | Lund | 175/52 |
| 4,854,397 | A | 8/1989 | Warren et al. | 175/26 |
| 4,862,973 | A | 9/1989 | Voigts et al. | 175/52 |
| 4,995,465 | A | 2/1991 | Beck et al. | 175/27 |
| 5,127,790 | A * | 7/1992 | Teague | 414/800 |
| 5,451,129 | A | 9/1995 | Boyadjieff et al. | 414/22.61 |
| 5,465,799 | A | 11/1995 | Ho | 175/61 |
| 5,671,961 | A * | 9/1997 | Buck | 294/116 |
| 5,988,299 | A | 11/1999 | Hansen et al. | 175/52 |
| 6,050,348 | A | 4/2000 | Richarson et al. | 175/26 |
| 6,513,605 | B1 * | 2/2003 | Lodden | 175/52 |
| 6,779,614 | B2 | 8/2004 | Oser | 175/85 |
| 6,802,378 | B2 | 10/2004 | Haci et al. | 175/26 |

(Continued)

*Primary Examiner* — Saul Rodriguez
*Assistant Examiner* — Lynn Schwenning
(74) *Attorney, Agent, or Firm* — Amerson Law Firm, PLLC

(57) ABSTRACT

Automated systems and apparatus for transferring tubulars (tubulars used in wellbore and derrick operations, such as casing, tubing, drill pipe, etc.) or stands of pipe from one location to another in a derrick, e.g. from a fingerboard to a well center are described. The system includes a fully automated drill pipe handling system to move and position the drill pipe through all the steps of the drilling process.

23 Claims, 15 Drawing Sheets

(56) References Cited

U.S. PATENT DOCUMENTS

| | | | | |
|---|---|---|---|---|
| 6,821,071 | B2 | 11/2004 | Woolslayer et al. | 414/22.63 |
| 6,918,453 | B2 | 7/2005 | Haci et al. | 175/26 |
| 6,944,547 | B2 | 9/2005 | Womer et al. | 702/7 |
| 6,976,540 | B2 | 12/2005 | Berry | 166/380 |
| 7,083,007 | B2 | 8/2006 | Herst | 175/52 |
| 7,431,550 | B2 * | 10/2008 | Thompson | 414/22.54 |
| 7,699,122 | B2 * | 4/2010 | Eriksen | 175/52 |
| 2006/0081379 | A1 | 4/2006 | Fehres et al. | 166/380 |
| 2007/0209484 | A1 * | 9/2007 | Chervenak et al. | 81/368 |
| 2008/0128167 | A1 * | 6/2008 | Eriksen | 175/52 |
| 2008/0174131 | A1 * | 7/2008 | Bouligny et al. | 294/88 |
| 2009/0056930 | A1 * | 3/2009 | Angelle et al. | 166/77.51 |
| 2009/0232624 | A1 | 9/2009 | Orgeron | 414/22.55 |
| 2009/0252576 | A1 | 10/2009 | Gerber et al. | 414/22.54 |
| 2009/0263221 | A1 | 10/2009 | Oldershaw | 414/495 |
| 2009/0274545 | A1 | 11/2009 | Liess et al. | 414/800 |
| 2010/0303586 | A1 * | 12/2010 | Hankins et al. | 414/22.51 |

* cited by examiner

DRILLING RIG PIPE TRANSFER SYSTEMS AND METHODS

BACKGROUND OF THE INVENTION

1. Field of the Invention

This present invention is directed to systems for moving tubulars, e.g., drill pipe, and pipe stands in a derrick; to systems for transferring pipe or a stand of pipe between a fingerboard area and a well center; and to methods of the use of such systems.

2. Description of the Related Art

The prior art discloses a wide variety of drilling systems, apparatuses, and methods including, but not limited to, the disclosures in U.S. Pat. Nos. 6,944,547; 6,918,453; 6,802,378; 6,050,348; 5,465,799; 4,995,465; 4,854,397; 4,850,439; and 3,658,138, all incorporated fully herein for all purposes. The prior art discloses a wide variety of tubular handling and tubular transfer systems for wellbore operations; for example, and not by way of limitation, those disclosed in U.S. Pat. Nos. 4,862,973; 4,765,401; 4,725,179; 4,462,733; 4,345,864; 4,274,778; 4,269,554; 4,128,135; 4,044,895; 4,042,123; 4,013,178; 5,451,129; 5,988,299; 6,779,614; 6,821,071; 6,976,540; 7,083,007; and in U.S. Application 2006/0081379 A1 (all said U.S. references incorporated fully herein for all purposes).

In certain well known well drilling methods, a string of drill pipe having a drill bit mounted on the lower end thereof is suspended from a traveling block in a drilling rig mast. The drill string is suspended from the traveling block by a swivel which enables rotational force to be applied to the drill string, typically by a rotary table at the drilling rig floor, or a power swivel or top drive in the derrick to advance the depth of the drilled bore. As the depth of the bore increases, additional lengths of drill pipe are added to the drill string at the surface.

Often, for various reasons, the drill string is pulled from the bore, e.g., in order to change the drill bit or to run testing or other equipment into the bore on the end of the drill string. When pulling drill pipe from the bore, the traveling block is raised until a stand (multiple connected pieces) of pipe extends above the drilling rig floor. In the usual case, a stand comprises two or three pieces of pipe, e.g. three pieces totaling approximately 90 feet in length. Next, slips are placed between the pipe and the drilling rig floor in order to suspend the drill string in the well bore from a point beneath the pipe stand which extends above the drilling rig floor. The connection between the pipe stand and the remainder of the drill string is unthreaded and the lower end of the stand is placed on a support pad, sometimes referred to as a setback, on the drilling rig floor. Next, a man positioned in the upper portion of the rig disconnects the upper end of the stand from the traveling block and places the upper end of the stand between a set of racking fingers on a fingerboard which support the stand in a substantially vertical position. The traveling block is then lowered to pick up the drill string and the process is repeated until all of the pipe, e.g. in three piece stands, is supported at the lower ends thereof on the setback with the upper ends being constrained between pairs of racking fingers on the fingerboard. When running a new drill bit or a tool into the well bore, this process is reversed. This process is repeated until the drill string is removed or, in the reverse process, when the drill bit reaches a desired depth in the well bore.

A variety of difficulties and dangers can be associated with procedures for running a drill string into or out of a well bore to personnel involved in these procedures, e.g., personnel working on a platform above a drilling rig floor. This job can entail reaching from the platform to the center line of the well in order to connect the upper end of a pipe stand to the traveling block (and to disconnect the same therefrom) and can require moving the upper end of each pipe stand between the racking fingers and the center line of the well.

Various prior art efforts have been made to automate one aspect or another of the procedure for running drill pipe into and out of the well bore. Some of these procedures incorporate the use of mechanical arms mounted on the drilling rig mast adjacent the racking fingers for moving the upper ends of the pipe stands between the well center line and the racking fingers. Some include lower arms or dollies for simultaneously gripping the lower end of the stand in order to move it between the well center line and the setback. Some of the prior art devices move the stands in response to control signals generated by a computer. Some of the prior art devices have disadvantages. Many are cumbersome in their design and thus in their operation and are expensive to build. Some prior art apparatuses have a single arm for manipulating pipe at the upper end of a pipe stand.

U.S. Pat. No. 4,725,179 discloses an automated racking apparatus for use to facilitate coupling and uncoupling substantially vertical lengths of pipe by moving the pipe between a coupled position and a racking assembly. An arm assembly includes a gripping head mounted thereon for grasping a pipe. Apparatuses are provided for moving the arm assembly. The lower end of a pipe received in the racking assembly is supported by a support assembly which includes sensor apparatus the location of the lower end of each pipe on the support assembly. Control apparatus connected to the sensor apparatus and to the moving apparatus is provided for moving the arm assembly to a preselected position dependent upon the position of the lower end of a pipe which is set on or removed from the support assembly. In one aspect, the arm assembly includes a first arm and a second arm which are extendable and retractable along axes oriented at ninety degrees to one another. In one aspect, U.S. Pat. No. 4,725,179 discloses an automated pipe racking apparatus for use to facilitate threading and unthreading substantially vertical lengths of pipe on a drilling rig by moving the pipe between the well bore center line and a racking assembly. An arm having a gripping head mounted thereon is extendable and retractable relative to a carriage mounted on the drilling rig working board. When storing pipe, the lower end of each pipe is set on a support assembly which includes a plurality of switches which signal the position of each pipe thereon. The arm and carriage are moved under control of a computer to an appropriate slot for storing the upper end of the pipe stand. When running pipe into the well bore, the arm and carriage move the upper end of the pipe to the center line of the well and when the traveling block of the drilling rig picks up the pipe, a signal generated by the switch beneath the pipe causes the carriage and arm to move to the location for unracking the next stand of pipe; which in one particular aspect, includes an arm assembly having a gripping head mounted thereon for grasping a pipe, apparatus for moving the arm assembly, a support assembly for supporting the lower end of a pipe received in the racking assembly, apparatus for sensing the location of the lower end of each pipe on the support assembly; and control apparatus operatively connected to the sensing apparatus and to the moving apparatus for moving the arm assembly to a preselected position dependent upon the position of the lower end of a pipe which is set on or removed from the support assembly.

U.S. Pat. No. 6,821,071 discloses an automated pipe racking apparatus for a drilling rig having an elevator suspended over a well bore. An arm support member is rotatable about an axis parallel to the well bore. A gripper arm extends from the arm support member along an axis normal to the axis of rotation of the arm support member. A gripper head assembly extends from the gripper arm, the gripper head assembly having a pair of opposed, arcuate gripper fingers, each said finger rotatable by a motor. In one aspect, an automated pipe racking process is disclosed for a drilling rig with an elevator suspended over a well bore, which process includes: lifting a pipe stand having at least one pipe section with the elevator; moving a lower end of the pipe stand over a base pad; setting the lower end of the pipe stand down onto a base pad; capturing the pipe stand with a gripper head assembly having a pair of rotating arcuate fingers; releasing the pipe stand from the elevator; and moving an upper end of the pipe stand with the gripper head assembly to a chosen location.

U.S. Pat. No. 7,083,007 discloses a fingerboard having at least one fingerboard row for storing a plurality of threaded tubulars with a plurality of latches connected to the at least one fingerboard row for lockingly retaining at least one threaded tubular, wherein each of the plurality of latches is movable between a locked position and an unlocked position. A row controller is connected to each of the latches for individually and sequentially moving the latches between the locked and unlocked positions, wherein the row controller is manually operable from a location remote from the latches such that the latches are manually and remotely controlled. In one aspect, a fingerboard is disclosed that includes: at least one fingerboard row for storing a plurality of threaded tubulars; a plurality of latches connected to the at least one fingerboard row for lockingly retaining at least one threaded tubular, wherein each of the plurality of latches is movable between a locked position and an unlocked position; and a row controller connected to each of the latches for individually and sequentially moving the latches between the locked and unlocked positions, wherein the row controller is manually operable from a location remote from the latches such that the latches are manually and remotely controlled. In one aspect, a method of storing a plurality of threaded tubulars in a fingerboard is disclosed that includes: providing a fingerboard row for storing the plurality of threaded tubulars; providing a casing having a plurality of exhaust ports, wherein each of the plurality of exhaust ports corresponds to at least one of the plurality of threaded tubulars; providing a piston having an elongated rod that is moveable relative to the casing; connecting a plurality of latches to the fingerboard row, wherein each of the plurality of latches is connected to a corresponding one of the plurality of exhaust ports and each latch is biased to a closed position and moveable between the closed position and an opened position; connecting an air source to the casing; moving the elongated rod to a fully extended position such that each exhaust port is uncovered by the elongated rod and air from the air source enters each uncovered exhaust port and forces each of the latches into a unlocked position; adding successive ones of the plurality of threaded tubulars to a position within the fingerboard row; and moving the elongated rod to one of a plurality of retracted positions to cover the corresponding exhaust port of each added threaded tubular causing each latch to be biased from the unlocked position to the locked position to lock each added threaded tubular to the fingerboard row.

U.S. Pat. No. 4,042,123 discloses a hydraulically powered pipe handling system, a general purpose digital computer is used to control the operation of hydraulically powered racker arms as well as the various auxiliary functions involved in vertical pipe racking operations. The manual pipe-racking system (that is, that which is hydraulically powered and under the control of one or more operators) is retained, the computer controlled mode of operation being an alternative system present in the overall design. There is provided to the operator, while the system is in its automatic mode of operation, visual indication of length of drill string, depth of hole, depth of drill bit and composition of the drill string, including number and type of pipe lengths making up the drill string. In one aspect, a drill pipe handling system for the automated handling of drill pipe lengths, in a well being drilled or otherwise serviced, is disclosed including: rack apparatus for receiving pipe stands and supporting the pipe stands in spaced apart vertical rows adjacent the side of a derrick, the rack apparatus including a series of parallel rows for receiving the pipe stands and fingers selectively actuable for forming rectangular openings along the parallel rows for locking the pipe stands in place; sensor apparatus for sensing the individual actuation of the fingers; racker apparatus for successively moving the drill pipe stands between a position adjacent the center of the derrick and the rack apparatus; a racker arm extending horizontally from the racker apparatus, the racker arm having a gripper at the outer end thereof for engaging the drill pipe stands; computer control apparatus for controlling the rack apparatus, the fingers, the racker apparatus, and the racker arm; the computer control apparatus including, a programmable general purpose digital computer; a computer program for providing sequential instructions to the digital computer; input-output apparatus for monitoring and controlling the digital computer; the input-output apparatus including, display apparatus for providing visual indication of the status of the computer program and for permitting data or instructions to be input to the digital computer; and a driller's console for permitting control of the drill pipe handling system by inputting instructions to the digital computer, the console including a selector for selecting automated or manual operations of the handling system, and controls and indicator apparatus for starting or stopping the automated function of the handling system and for providing visual indication of the operating status of the handling system.

BRIEF SUMMARY OF THE INVENTION

The present invention discloses, in certain aspects, systems for transferring tubulars (tubulars used in wellbore and derrick operations, such as casing, tubing, drill pipe, etc.) or stands of pipe from one location to another in a derrick, e.g. from a fingerboard to a well center.

In some embodiments, the present invention may include features and advantages which are believed to enable it to advance derrick pipe transfer technology. Certain embodiments of this invention are not limited to any particular individual feature disclosed here, but include combinations of them in their structures, functions, and/or results achieved. Some features of the invention have been broadly described so that the detailed descriptions that follow may be better understood, and in order that the contributions of this invention to the arts may be better appreciated. There are, of course, additional aspects of the invention described herein which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention.

Disclosed herein are new, useful, unique, efficient, nonobvious systems and methods for transferring tubulars within a wellbore derrick. To one of skill in this art who has the benefits of this invention's disclosures, various purposes and advantages will be appreciated from the following description of certain preferred embodiments, when taken in conjunction with the accompanying drawings. The detail in these descriptions is not intended to limit the scope of the invention.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 7O is a top view illustrating a step after the step of FIG. 7N.

Figure 1:
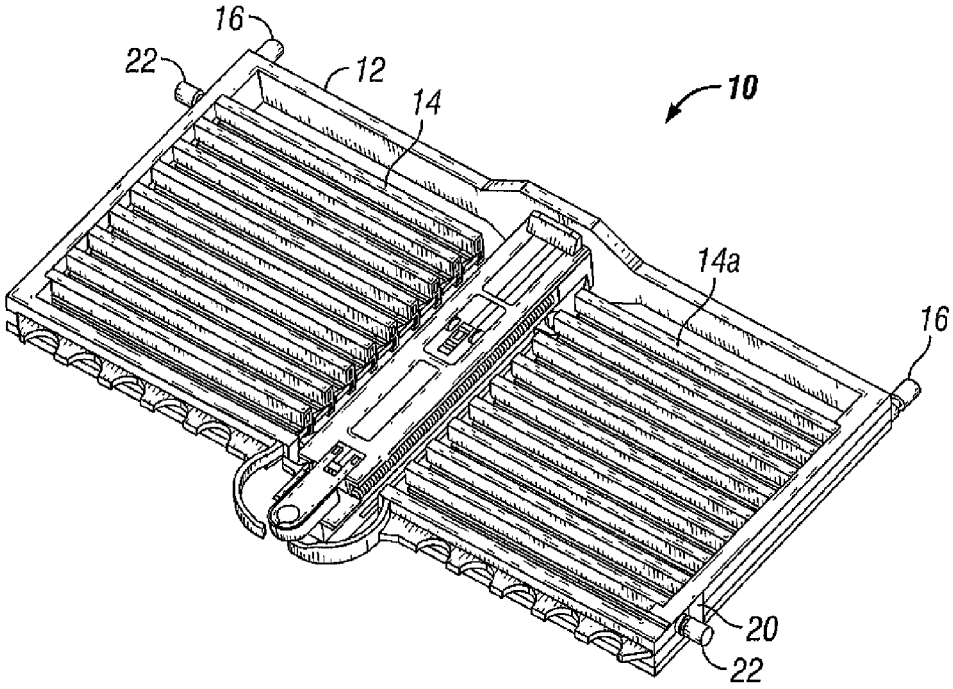
FIG. 1 is a perspective view of a tubular handling system according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory, any aspect or feature or combination of aspects or features of any embodiment disclosed herein may be used in any other embodiment disclosed herein.

DETAILED DESCRIPTION OF THE INVENTION

Figure 2A:
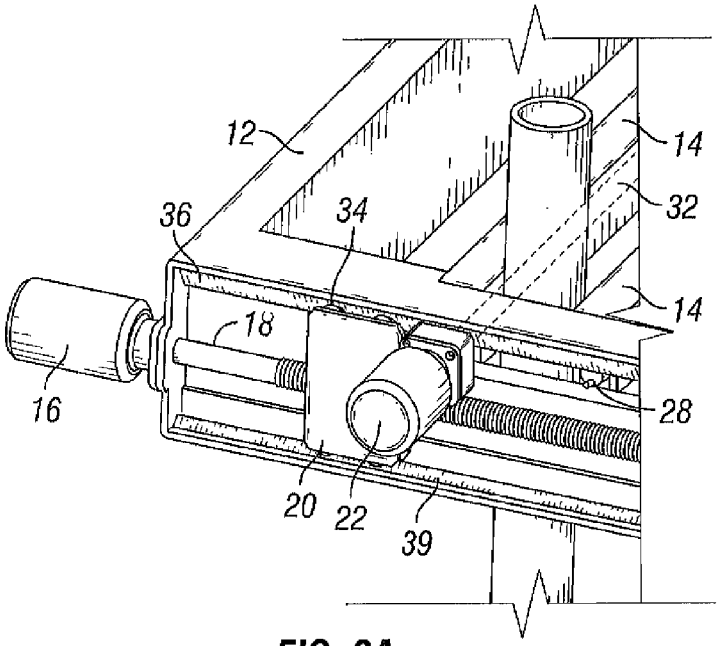
FIG. 2A is a perspective view of a carrier supporting a drive motor which drives a shaft of part of the system of FIG. 1.
Figure 2B:
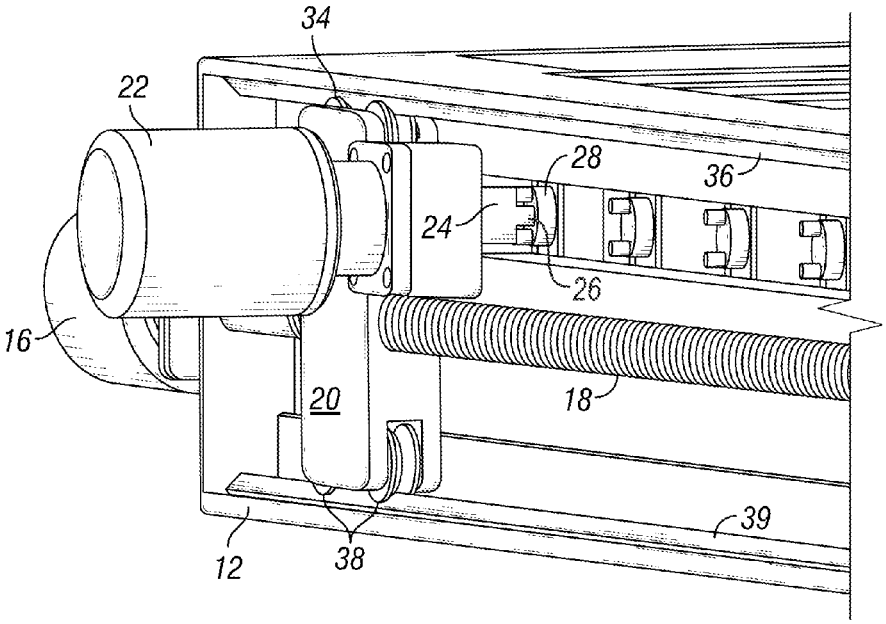
FIG. 2B is a another perspective view of perspective view of a carrier supporting a drive motor which drives a shaft of part of the system of FIGS. 1 and 2A.
Figure 2C:
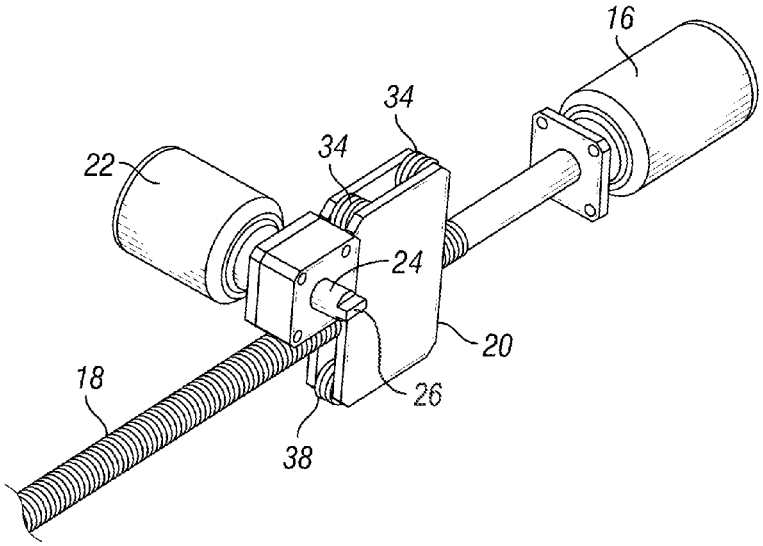
FIG. 2C is a close up perspective view of the drive motors and shafts of FIG. 2B.
Figure 6:
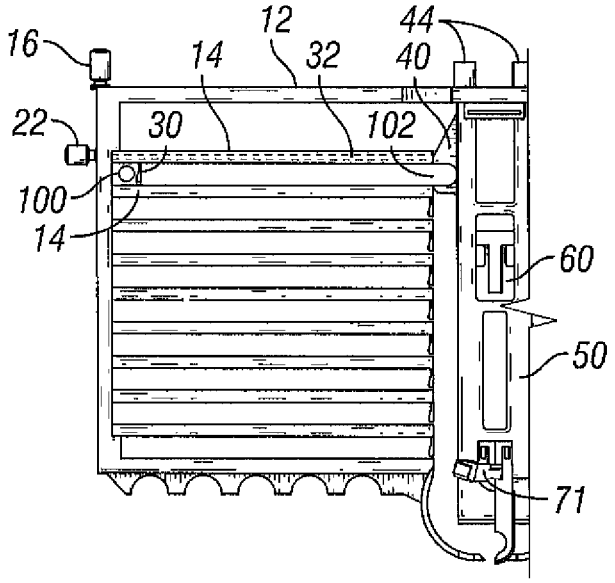
FIG. 6 is a top view of part of the system of FIG. 1 with a pipe in a cradle between fingers of the of tubular handling system of FIG. 1.
Figure 7A:
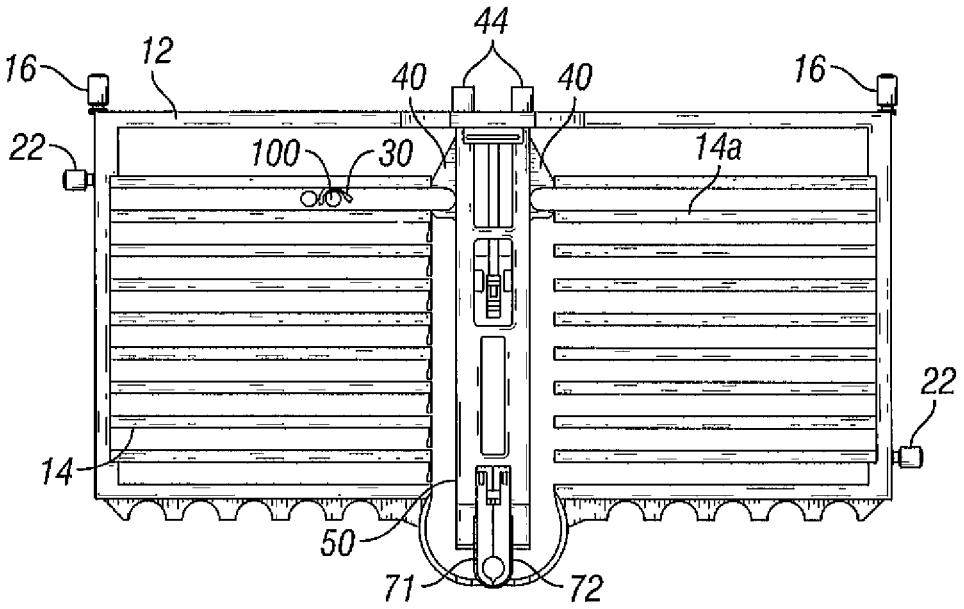
FIG. 7A is a top view of the system of FIG. 1 illustrating a step in a method for using the system.
Figure 7B:
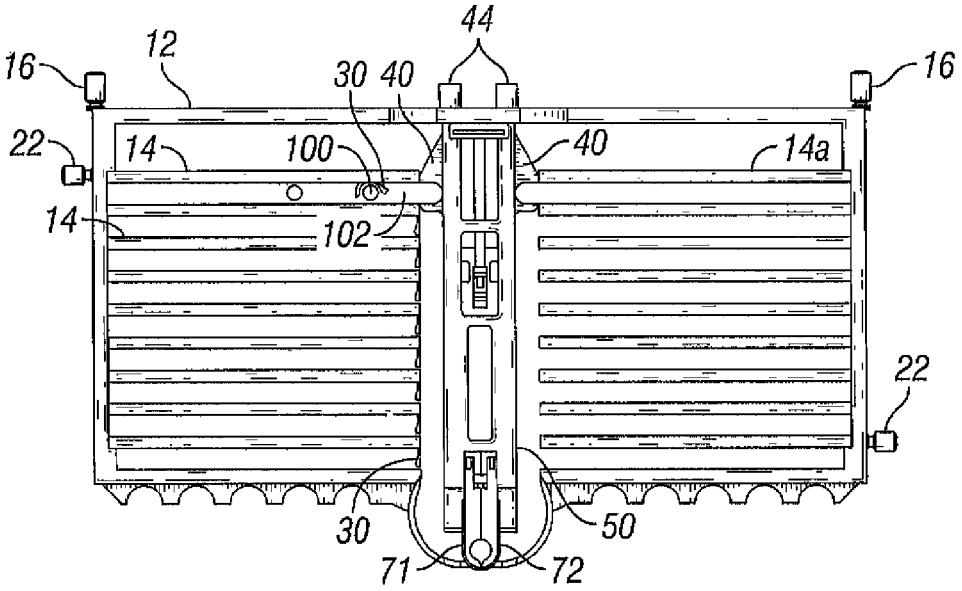
FIG. 7B is a top view illustrating a step after the step of FIG. 7A.
Figure 7C:
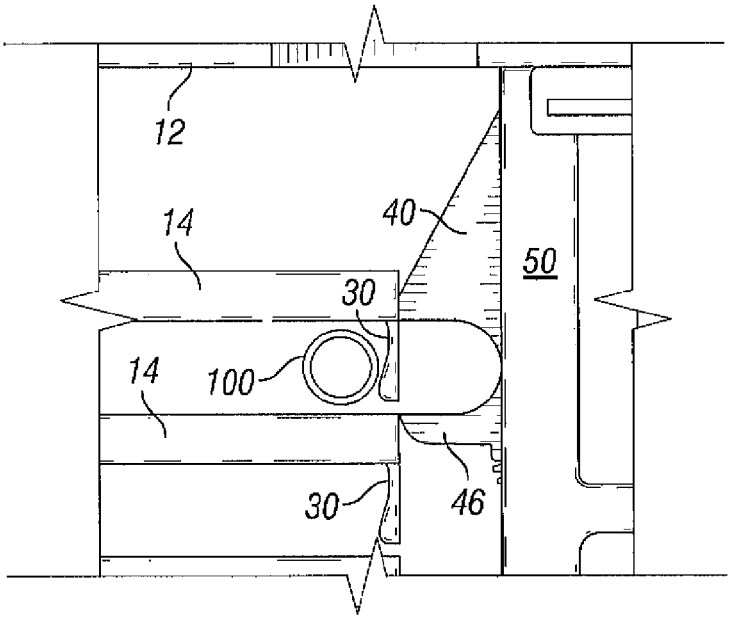
FIG. 7C is a top view illustrating a step after the step of FIG. 7B.

Referring now to FIG. 1, a system 10 according to the present invention has a base 12 with two sets of a plurality of spaced-apart fingers 14 and 14*a*. Since the two sets operate in a similar manner, the remainder of the description will be drawn to the spaced-apart fingers as indicated as numeral 14. Drive motors 16 rotate a lead screw 18 which moves carriers 20 to a selected location with respect to a selected finger 14. Each carrier 20 supports a drive motor 22 which drives a shaft 24 (as shown in FIG. 2B. The shafts 24 have ends 26 which mesh with ends 28 of cradle shafts 32 as shown in FIG. 6. Thus one set of drive motors 22 may be used to rotate the cradle shafts 32 to move cradles 30 (as shown in FIGS. 6 through 7E) with respect to the fingers 14.

Each carrier 20 has top rollers 34 which move on a top rail 36 of the base 12 and bottom rollers 38 that move on a bottom rail 39 of the base 12.

Figure 3:
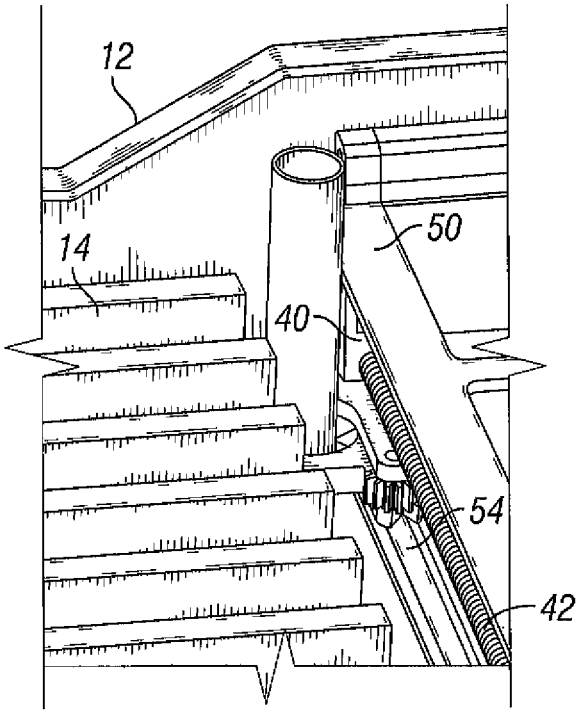
FIG. 3 is a perspective view base and fingers of the tubular handling system of FIG. 1.
Figure 4:
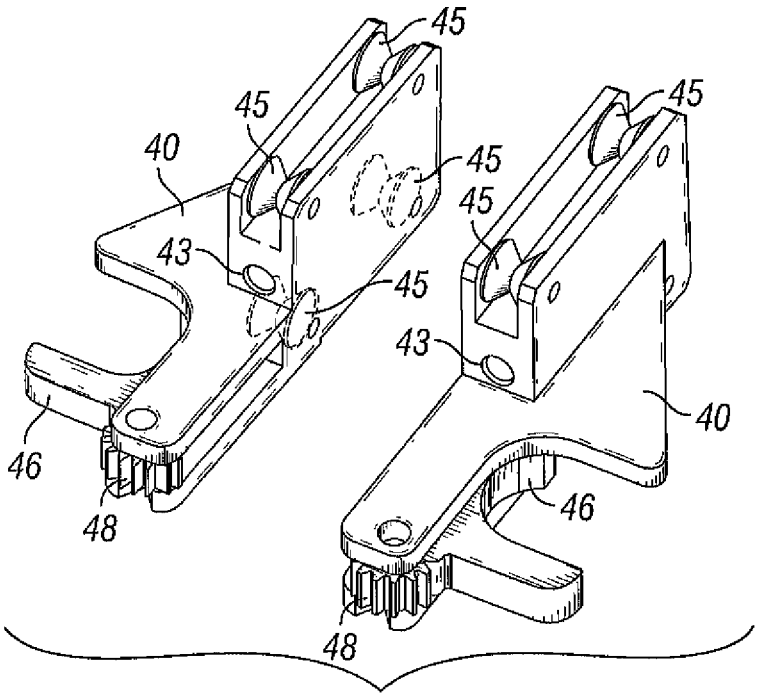
FIG. 4 is a perspective view of the trolleys of the tubular handling system of FIG. 1.

Two trolleys 40 (see FIGS. 3 and 4) are movably mounted on a central mount 50. Lead screws 42 driven by trolley motors 44 mesh with threaded channels 43 to selectively move the trolleys 40 to a desired location with respect to a selected finger 14. Each trolley 40 has a movable cradle 46, each with a gear-toothed end 48. When the trolley motors 44 move the trolleys 40 to the end of the central mount 50, each of the gear-toothed ends 48 meshes with a corresponding rack 52 (see FIG. 7L, e.g.) so that further movement rotates the cradles 46 with a tubular as described in detail below.

Each trolley 40 is supported by a support rail 54. Rollers 45 of each trolley roll on the support rail 54.

Figure 5A:
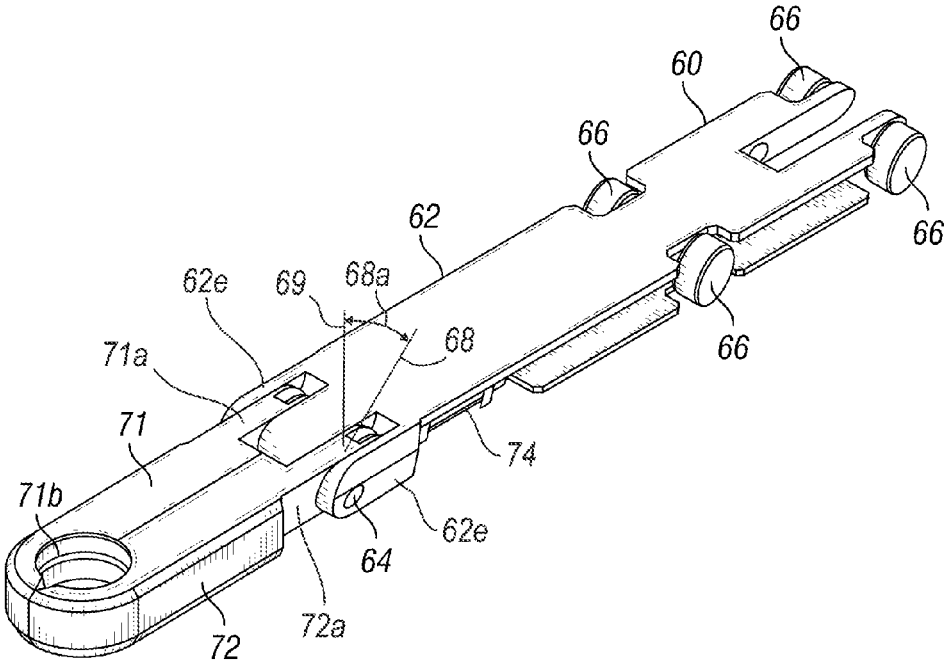
FIG. 5A is a perspective view of the jaws of tubular handling system of FIG. 1.
Figure 5B:
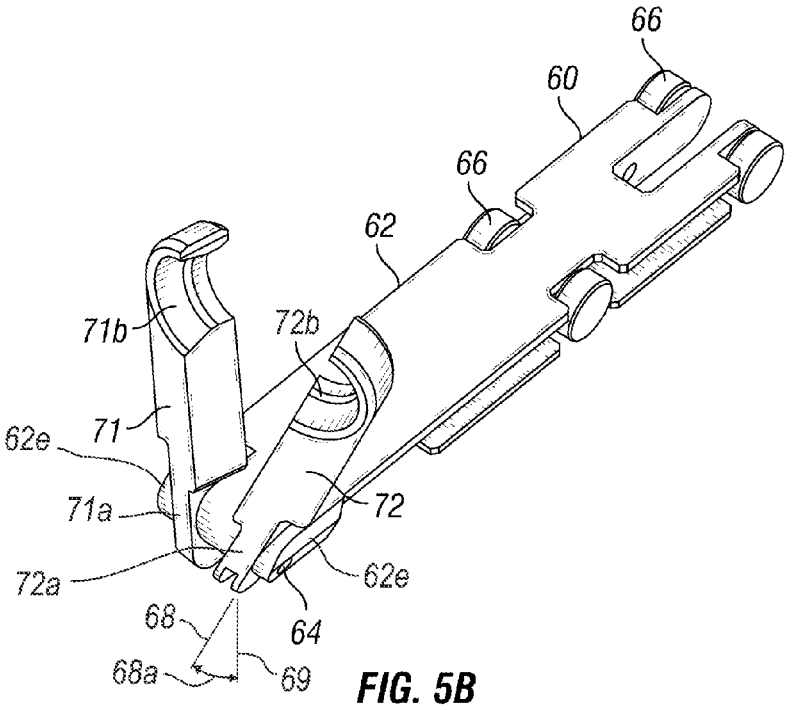
FIG. 5B is another perspective view of the jaws of tubular handling system of FIG. 1
Figure 5C:
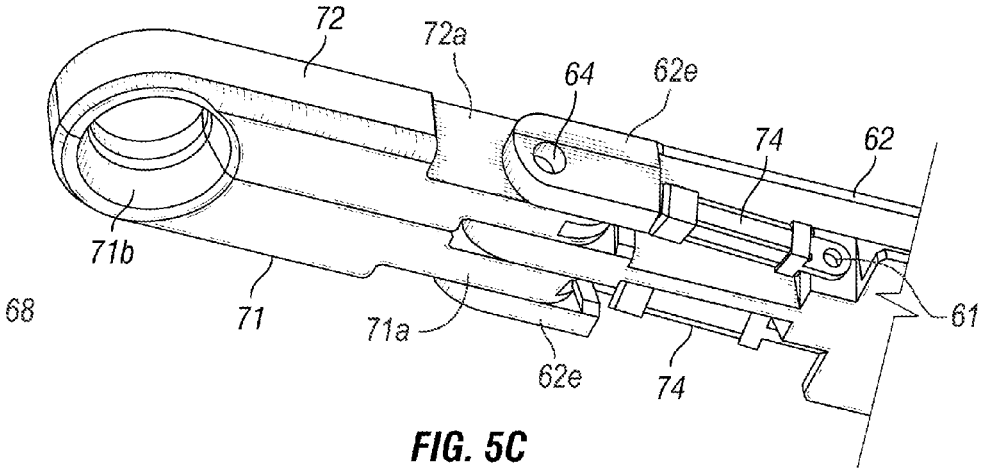
FIG. 5C is a still another perspective view of the jaws of tubular handling system of FIG. 1.
Figure 5D:
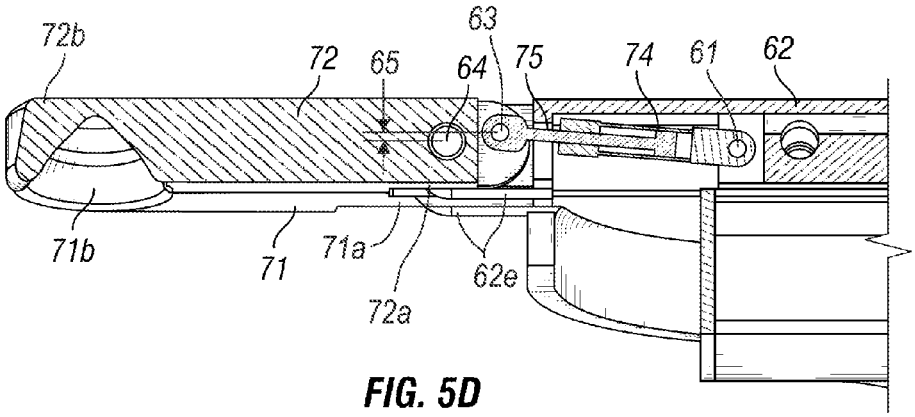
FIG. 5D is a partial cross-section view of the jaws of tubular handling system of FIG. 1.
Figure 5E:
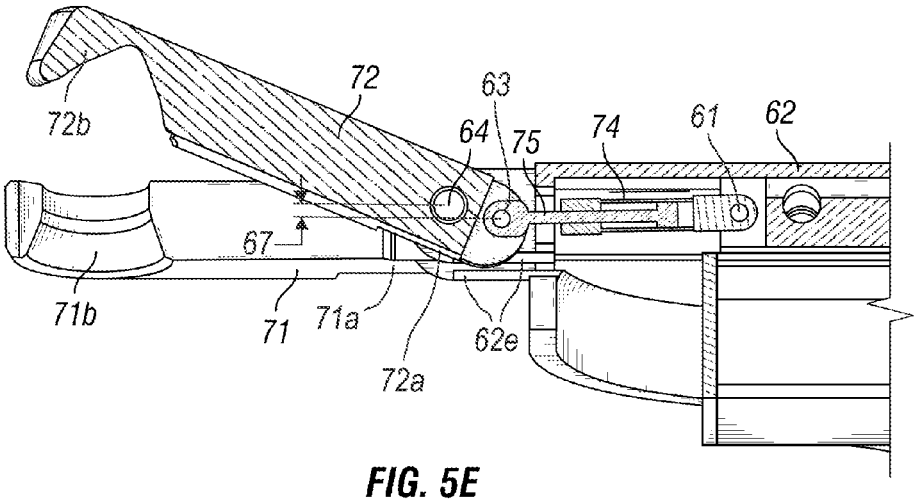
FIG. 5E is a partial cross-section view of the jaws of tubular handling system of FIG. 1 and as also shown in FIG. 5D.

FIGS. 5A-5E illustrate various aspects of a carriage arm 62 that extends from a carriage 60 and which is movable within the central mount 50. Two jaws 71, 72, each having a respective connection portion 71*a*, 72*a*, are pivotably connected to the carriage arm 62. As shown in FIGS. 5A-5C, each connection portion 71*a*, 72*a*, is pivotably connected to a respective extension portion 62*e* of the carriage arm 62 on a respective shaft 64. The carriage 60 has rollers 66 which facilitate movement of the carriage 60 on the central mount 50. Each jaw 71, 72 also has a bowl portion 71*b*, 72*b*, respectively, that is shaped and configured to accommodate a tubular held by the jaws 71, 72. As shown in FIGS. 5C-5E, a fluid-powered piston-cylinder apparatus 74 is pivotably connected to each respective jaw 71, 72. Furthermore, each piston-cylinder apparatus 74 may be selectively actuated to pivotably rotate a respective jaw 71, 72 between a substantially horizontal "down" and "in" closed position (i.e., where the jaws 71, 72 and bowl portions 71*b*, 72*b* are together, as shown in FIG. 5A) and a raised "up" and "apart" open position (i.e., where the jaws 71, 72 and bowl portions 71*b*, 72*b* are separated, as shown in FIG. 5B), as will be further described with respect to FIGS. 5A and 5B below. To facilitate the pivotable rotation of the jaws 71, 72, the piston-cylinder apparatuses 74 are attached to the carriage arm 62 at respective pivotable connections 61 and a piston 75 of each piston-cylinder apparatus 74 is attached to a respective jaw 71, 72 at a pivotable connection 63.

FIGS. 5D and 5E represent partial cross-sectional views taken through the jaw 72 of the tubular handling system 10 of FIG. 1. As shown in FIG. 5D, the center of the pivotable connection 63 between the piston-cylinder apparatus 74 and the connection portion 72*a* of the jaw 72 is positioned in a horizontal plane that is located a distance 65 above the horizontal plane containing the center of the shaft 64 connecting the jaw 72 to an extension portion 62*e* of the carriage 62. In order to raise the jaw 72 from its substantially horizontal position shown in FIG. 5D, the illustrative piston-cylinder apparatus 74 can be selectively actuated so as to retract the piston 75. In this way, since the center of the pivotable connection 63 is above the center of the shaft 64, as the piston 75 is retracted, the center of the pivotable connection 63 moves downward relative to the center of the shaft 64 as the jaw 72 rotates about the shaft 64, thereby raising the bowl end 72*b* of the jaw 72, as shown in FIG. 5E.

Returning now to FIGS. 5A and 5B, the respective connection portions 71*a*, 72*a* of the jaws 71, 72 and the extension portions 62*e* of the carriage arm 62 are configured so that an interface 68 between the connection portions 71*a*, 72*a* and the corresponding extension portions 62*e* is angled, i.e., at an angle 68*a*, relative to a substantially vertically oriented plane or vertical direction 69. Additionally, each shaft 64 is positioned and arranged so the axis of the shaft 64 is substantially perpendicular to a respective angled interface 68, so that when a jaw 71, 72 is pivotably rotated about a shaft 64, the jaw 71, 72 moves along an angled plane. It should be understood that the angle of the angled plane through which each jaw 71, 72 rotates is substantially defined by the angle 68*a* of the respective angled interface 68. Accordingly, when the jaws are "down" in a substantially horizontal orientation and the bowl portions 71*b*, 72*b* are in a closed position (e.g., moved together as shown in FIG. 5A and/or enclosing or encircling a pipe 100 as shown in FIG. 7M), the jaws 71, 72 can be rotated upward about the shafts 64, i.e., both "up" and "apart" and substantially along the previously-noted angled plane, so that the bowl portions 71*b*, 72*b* are in an open position as shown in FIG. 5B (e.g., separated so as to release a pipe 100 or to prepare to receive a pipe 100). Conversely, when the bowl portions 71*b*, 72*b* are in the open positioned (i.e., "up and "apart," or separated), the jaws 71, 72 can be rotated downward about the shafts 64, i.e., both "down" and "in" and substantially along the angled plane corresponding to the angled interface 68, so that the bowl portions 71*b*, 72*b* are once again moved together in a closed position and the jaws 71, 72 are in a substantially horizontal orientation, as shown in FIGS. 5A and 7M.

Additionally, it should be appreciated that a first angled interface 68 between the connection portion 71*a* of the jaw 71 and a respective extension portion 62*a* substantially mirrors a second angled interface 68 between the connection portion 72*a* of the jaw 72 and a respective extension portion 62*a* relative to the substantially vertical plane 69, such that the angle 68*a* of each angled interface 68 has substantially the same magnitude but is oriented on opposite sides of the vertical plane 69. In this way, the rotational movement of the jaw 71 substantially mirrors that of the jaw 72, thus facilitating the movement apart, or "opening" (i.e., separation) of the bowl portions 71*b*, 72*b* as the jaws 71, 72 are rotated upward, or raised, and the movement together, or "closing," of the bowl portions 71*b*, 72*b* as the jaws 71, 72 are rotated downward, or lowered, to a substantially horizontal position.

Figure 7D:
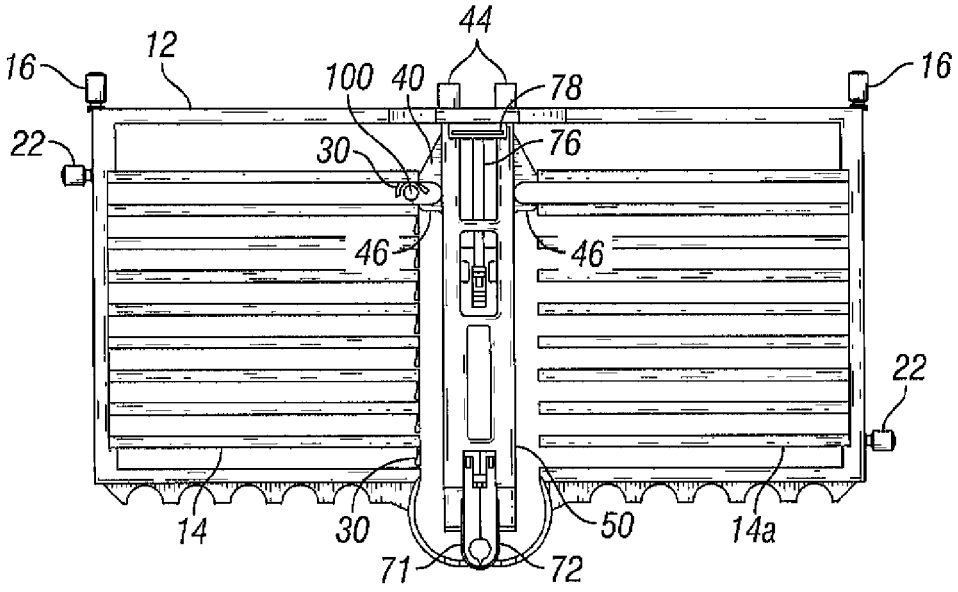
FIG. 7D is a top view illustrating a step after the step of FIG. 7C.
Figure 7E:
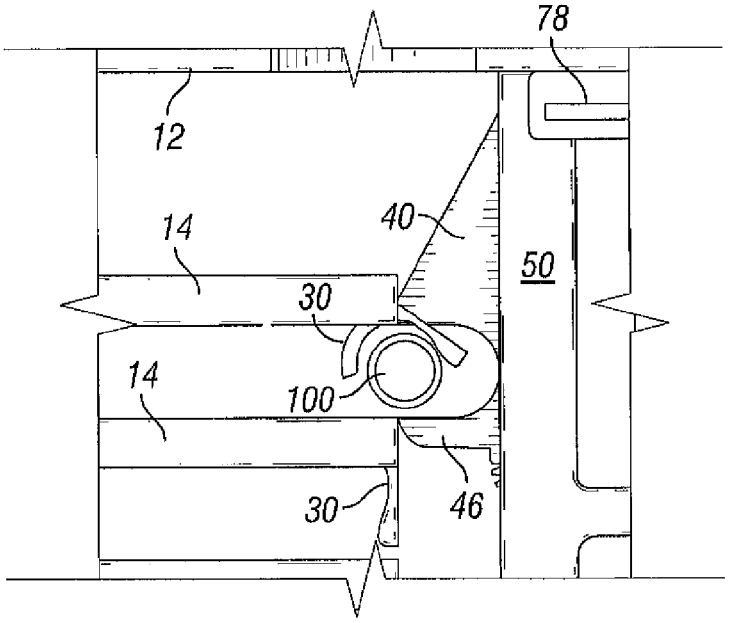
FIG. 7E is a top view illustrating a step after the step of FIG. 7D.

A lead screw 76 driven by a carriage motor 78 moves the carriage 60 with respect to the central mount 50 (see, e.g., FIG. 7D).

As shown in FIG. 6, a cradle 30 is adjacent a pipe 100 and a trolley 40 is located adjacent an opening 102 between two fingers 14. The drive motor 22 is in position to move a shaft 32 to move the pipe 100 toward the trolley 40. The first jaw 71 is in an "up" position. Of course the system 10 may have multiple pieces of pipe between all the fingers 14.

FIG. 7A shows a cradle 30 moved into position about a piece of pipe 100 (which may be a single stand or may be a double or perhaps even a triple stand. Both jaws 71, 72 are in a "down" and "in" position. As shown in FIG. 7B, the drive motor 22 has moved the cradle 30 and pipe 100 toward the trolley 40. As shown in FIG. 7C, the pipe 100 is near the interior ends of the fingers 14 and part of the cradle 30 blocks the entry of the pipe 100 into the trolley 40.

Figure 7F:
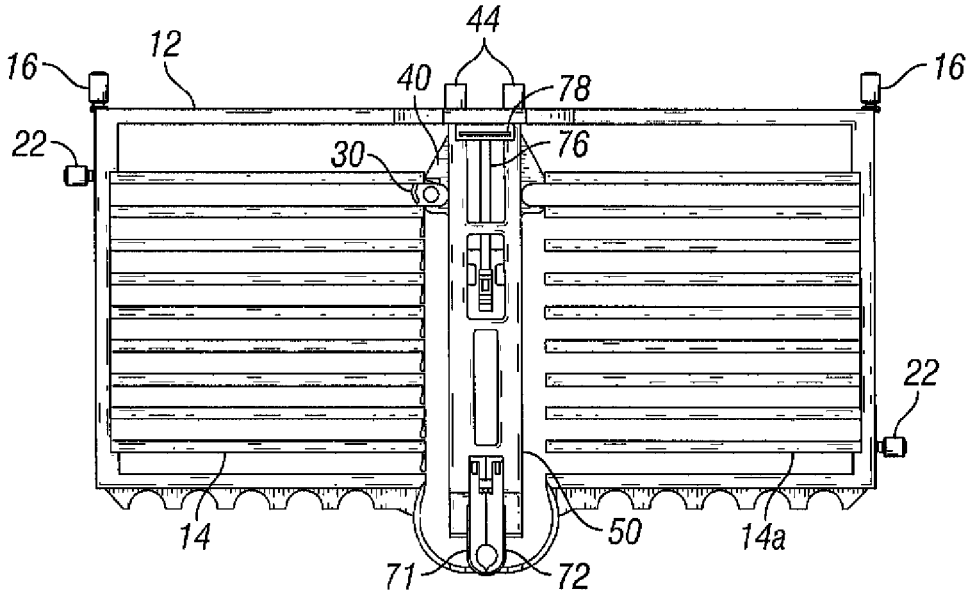
FIG. 7F is a top view illustrating a step after the step of FIG. 7E.
Figure 7G:
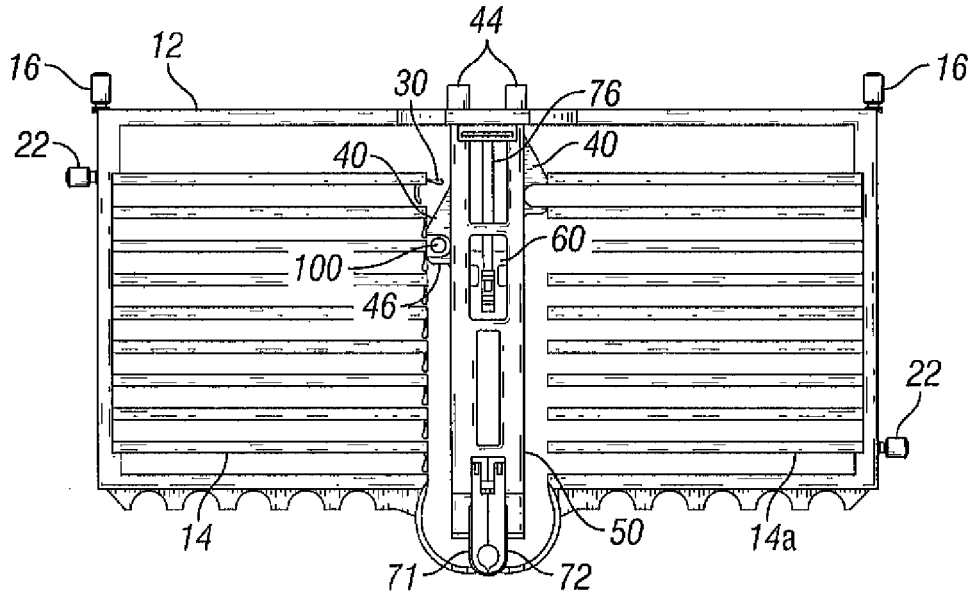
FIG. 7G is a top view illustrating a step after the step of FIG. 7F.
Figure 7H:
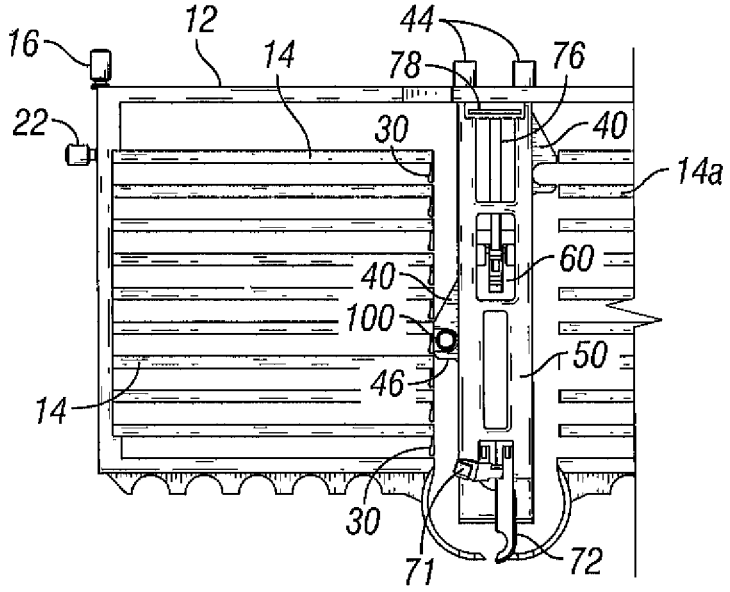
FIG. 7H is a top view illustrating a step after the step of FIG. 7G.
Figure 7I:
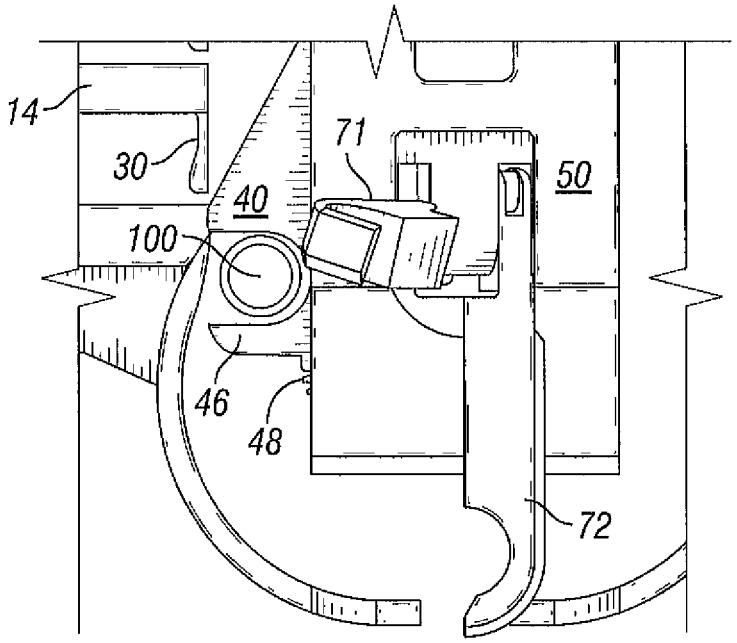
FIG. 7I is a top view illustrating a step after the step of FIG. 7H.
Figure 7J:
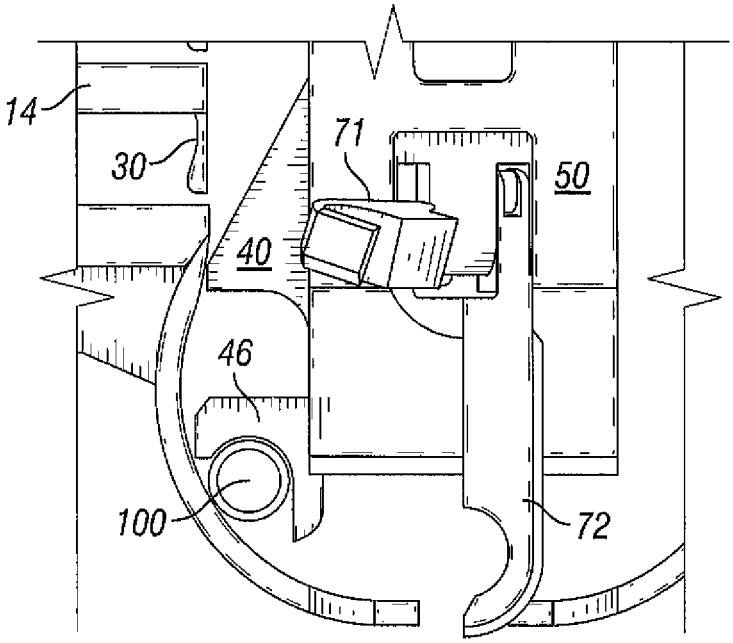
FIG. 7J is a top view illustrating a step after the step of FIG. 7I.

FIGS. 7D and 7E illustrate tilting of the cradle 30 (by the further driving of the shaft 32 by the drive motor 22) to move the pipe 100 and to permit the pipe 100 to enter the trolley 40. FIG. 7F shows the pipe 100 moved into the trolley 40. As shown in FIG. 7G, a trolley motor 44 has moved the trolley 40 towards the first jaw 71. FIGS. 7H, 7I, and 7J illustrate the trolley 40 progressing toward the first jaw 71, and the first jaw 71 has been moved up and out of the way so the pipe 100 can be positioned between the jaws 71, 72, which may be adapted to swing upwards away from each other with the use of a hydraulic cylinder, such as the fluid-powered piston-cylinder apparatus 74 shown in FIGS. 5C-5E and described above, or other suitable device.

Figure 7K:
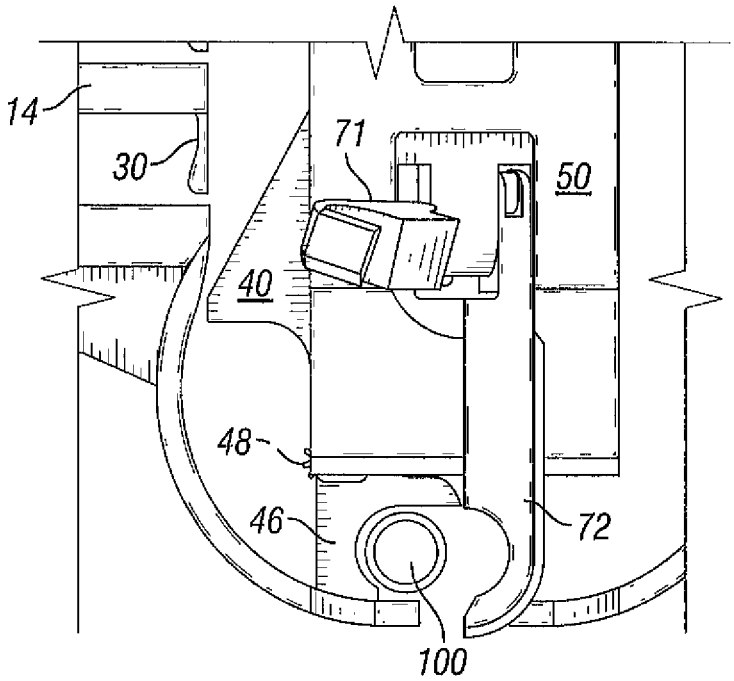
FIG. 7K is a top view illustrating a step after the step of FIG. 7J.
Figure 7L:
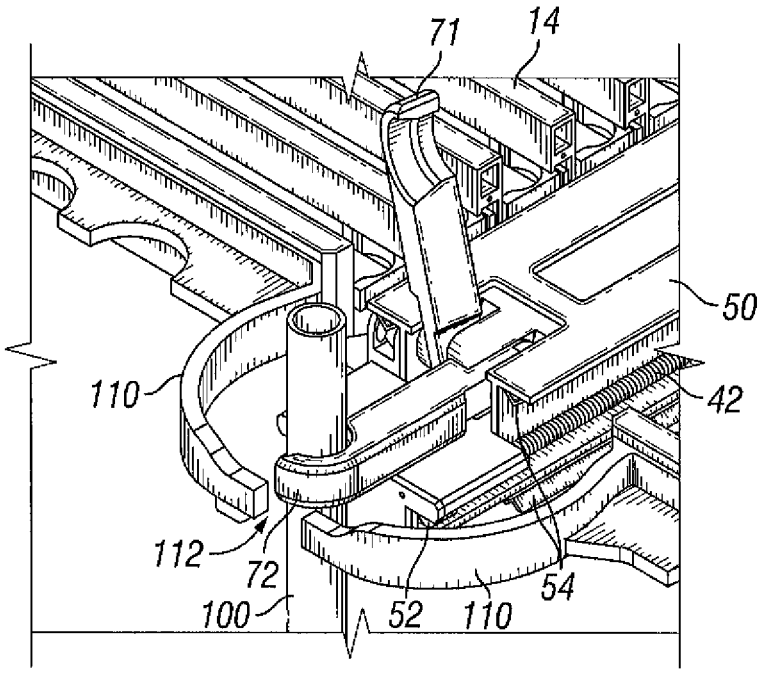
FIG. 7L is a top view illustrating a step after the step of FIG. 7K.
Figure 7M:
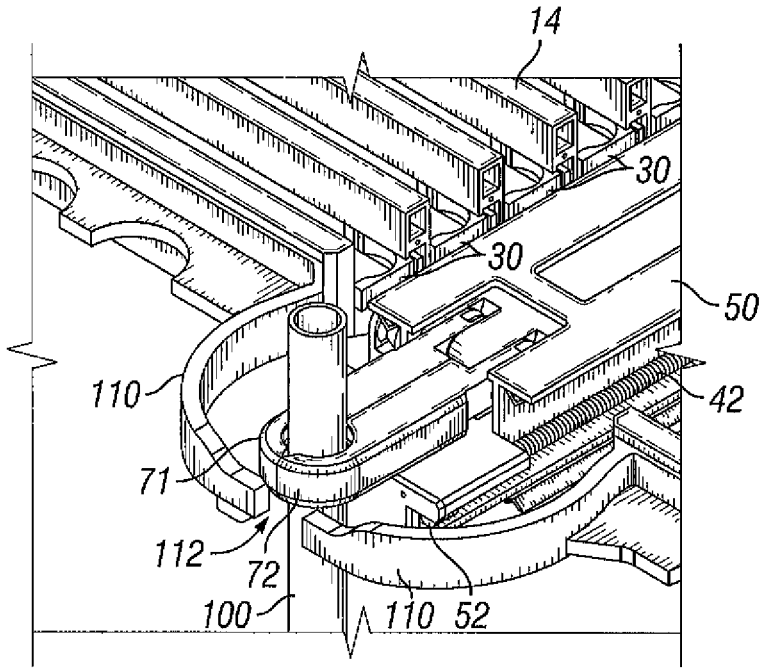
FIG. 7M is a top view illustrating a step after the step of FIG. 7L.

As shown in FIG. 7K, the cradle 46 has been turned (with the end 48 acting on the rack 52) and has moved the pipe 100 toward the second jaw 72 while the first jaw 71 is up and out of the way. FIG. 7L shows the pipe 100 in position adjacent the second jaw 72. FIG. 7M shows the first jaw 71 lowered and the pipe 100 positioned between the two jaws 71, 72.

Figure 7N:
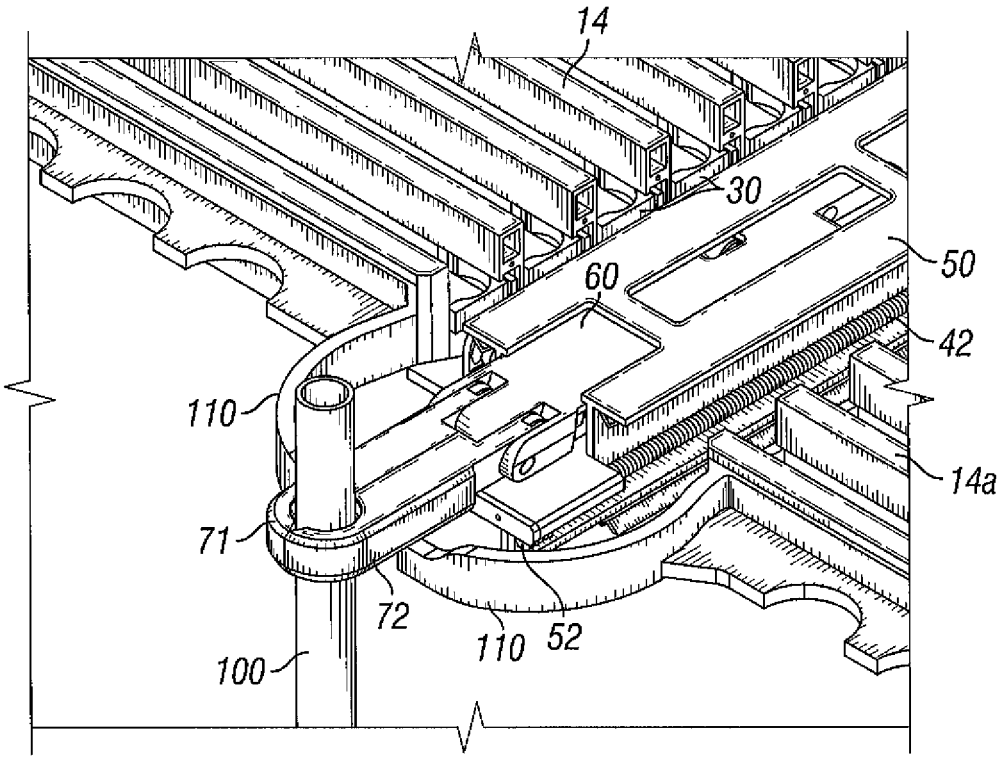
FIG. 7N is a top view illustrating a step after the step of FIG. 7M.
Figure 70:
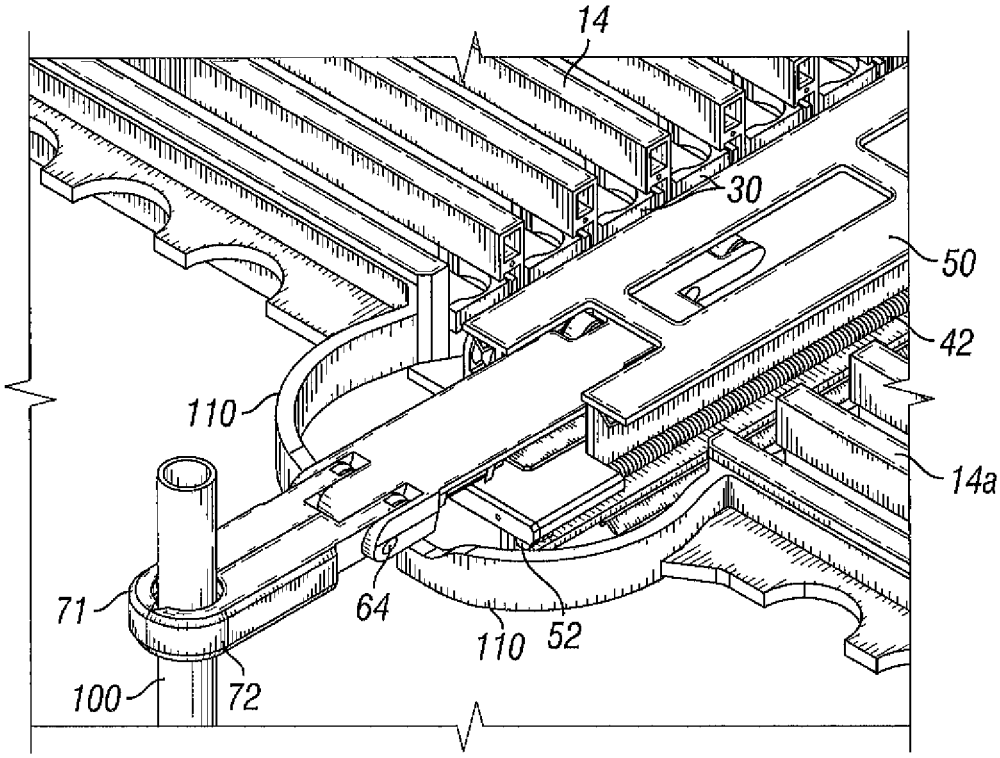

As shown in FIG. 7N, the carriage 60 has been moved to move the pipe 100 through an opening 112 between the ends of arms 110 (see, FIGS. 7L, 7M). FIG. 7O illustrates further movement of the pipe 100, supported by the jaws 71, 72 away from the arms 110, e.g., to position the pipe 100 for engagement by an elevator 120.

Figure 7P:
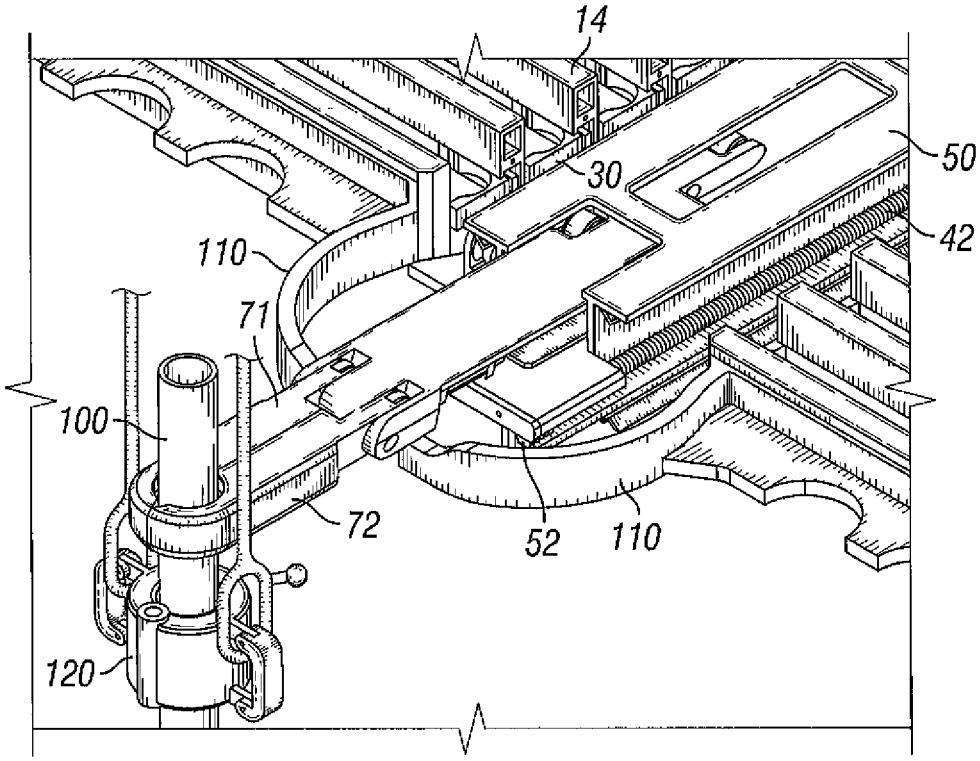
FIG. 7P is a top view illustrating a step after the step of FIG. 7O.
Figure 7Q:
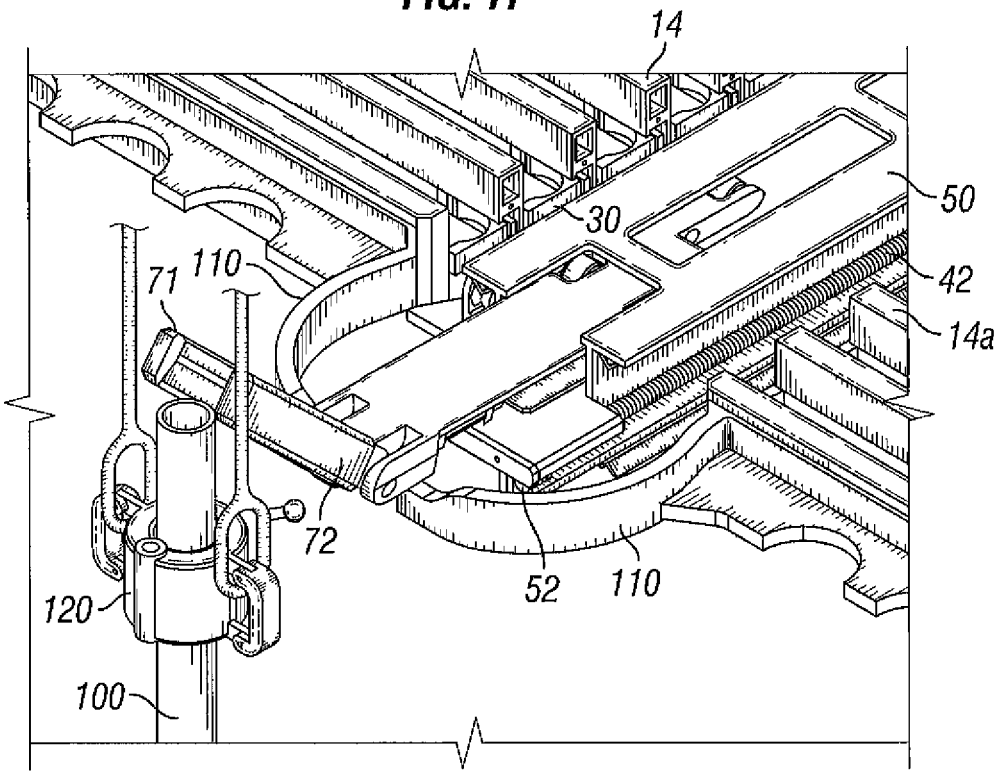
FIG. 7Q is a top view illustrating a step after the step of FIG. 7P.

FIG. 7P shows the elevator 120 engaging the pipe 100. As the elevator 120 (with the pipe 100) is moved up, the elevator 120 bumps the jaws 71, 72 from below, opening and disengaging the jaws 71, 72 from the pipe 100, moving them both "up" and "apart" to an open position and out of the way (see FIG. 7Q). As illustrated in the partial cross-sectional views of the jaws shown in FIGS. 5D and 5E, when the jaws 71, 72 are bumped from below by the elevator 120, i.e., urged upward, the center of the pivotable connection 63 is moved from its original (i.e., jaws closed) position in the horizontal plane that is a distance 65 above that of the center of the shaft 64 to a position in a different horizontal plane that is a distance 67 below the center of the shaft 64. In this way, pressure in the piston-cylinder apparatus 74 acts to maintain the center of the pivotable connections 63 in a position that is below that of the center of the shaft 64, thus holding the bowl ends 71*b*, 72*b* of the respective jaws 71, 72 in their "up" and "apart" open position, where they will remain for the duration of the cycle.

Figure 7R:
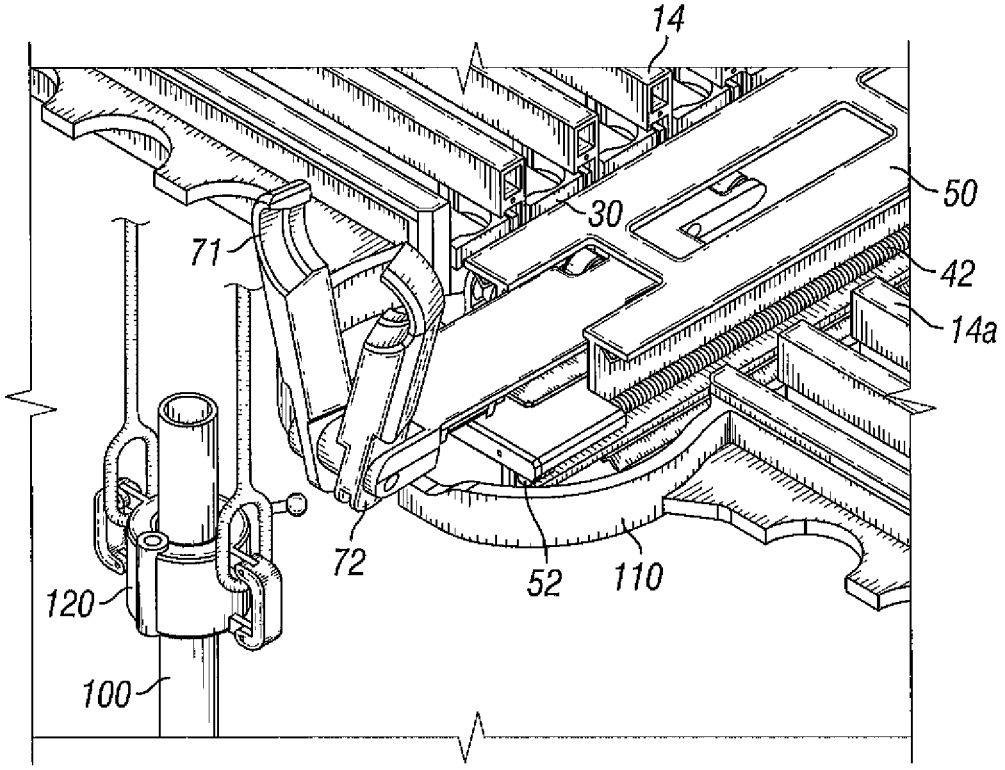
FIG. 7R is a top view illustrating a step after the step of FIG. 7Q.

As shown in FIG. 7R, the jaws 71, 72 may also be moved "up" and "apart" to their open position by actuating the fluid-powered piston-cylinder apparatus 74 shown in FIGS. 5C-5E and further described above. This then clears the path and allows the elevator 120 to move the pipe 100. The jaws 71, 72 may remain in the up position until they are again needed to hold another pipe 100 in position.

It is within the scope of the present invention to employ any suitable known movement apparatus, powered device, or motorized structure to move the cradles 30, the trolleys 40, and/or the carriage 60; including, but not limited to, piston-cylinder apparatuses and/or pneumatically and/or hydraulically and/or electrically powered equipment.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. A reference to an element by the indefinite article "a" does not exclude the possibility that more than one of the element is present, unless the context clearly requires that there be one and only one of the elements.

Whereas the present invention has been described in particular relation to the drawings attached hereto, it should be understood that other and further modifications apart from those shown or suggested herein, may be made within the scope and spirit of the present invention.

What is claimed is:

1. A device for supporting pipe, the device comprising:

a support structure;

a first pipe engagement jaw comprising a first end that is pivotably connected to said support structure at a first pivotable connection and a second end that is adapted to receive and engage with a substantially vertically oriented pipe, said first pivotable connection comprising a first angled interface between said first pipe engagement jaw and said support structure, said first pipe engagement jaw being pivotably rotatable about said first pivotable connection in a first angled plane, an angle of said first angled plane being substantially defined by an angle of said first angled interface relative to a substantially vertical plane; and a second pipe engagement jaw comprising a first end that is pivotably connected to said support structure at a second pivotable connection and a second end that is adapted to receive and engage with said substantially vertically oriented pipe, said second pivotable connection comprising a second angled interface between said second pipe engagement jaw and said support structure, said second pipe engagement jaw being pivotably rotatable about said second pivotable connection in a second angled plane that is different from and oriented at a non-zero angle relative to said first angled plane, an angle of said second angled plane being substantially defined by an angle of said second angled interface relative to said substantially vertical plane, wherein said first and second pivotable connections are adapted to move said second ends of said first and second pipe engagement jaws down and together to a closed position and to move said second ends up and apart to an open position by pivotably rotating said first and second pipe engagement jaws about said respective first and second pivotable connections in said respective first and second angled planes.

2. The device of claim 1, wherein second angled plane substantially mirrors said first angled plane relative to said substantially vertical plane.

3. The device of claim 1, wherein said first and second pipe engagement jaws are adapted to be pivotably rotated down to a substantially horizontal position when said second ends of said first and second pipe engagement jaws are in said closed position and pivotably rotated up to a raised position when said second ends of said first and second pipe engagement jaws are in said open position, said second ends being further adapted to cooperatively engage with and support a substantially vertically oriented pipe when in said closed position.

4. The device of claim 3, further comprising first and second jaw movement apparatuses that are operatively coupled to respective first and second pipe engagement jaws, wherein each of said first and second jaw moving apparatuses are adapted to selectively pivot said respective first and second pipe engagement jaws between said substantially horizontal position and said raised position.

5. The device of claim 4, wherein said first and second jaw moving apparatuses are adapted to maintain said respective first and second pipe engagement jaws in said raised position after said first and second pipe engagement jaws are bumped from below by an apparatus that is moving relative to said first and second pipe engagement jaws.

6. The device of claim 4, wherein each of said first and second jaw moving apparatuses comprise a fluid-powered piston-cylinder apparatus.

7. The device of claim 3, wherein a first one of said first and second pipe engagement jaws is adapted to be maintained in said substantially horizontal position while a second one of said first and second pipe engagement jaws is selectively pivotably rotated to said raised position.

8. The device of claim 7, wherein said second end of said first one of said first and second pipe engagement jaws is adapted to receive and engage with a substantially vertically oriented pipe while said second one of said first and second pipe engagement jaws is maintained in said raised position.

9. The device of claim 3, wherein said support structure is adapted to movably position a substantially vertically oriented pipe so that an apparatus that is moving relative to said first and second pipe engagement jaws can engage said pipe, bump said first and second pipe engagement jaws from below, disengage said second ends of said respective first and second pipe engagement jaws from said cooperative supporting engagement with said pipe, and pivotably rotate said first and second pipe engagement jaws in said respective first and second angled planes from said closed position to said open position.

10. The device of claim 1, wherein each of said second ends of said respective first and second pipe engagement jaws comprise a substantially bowl shaped portion that is adapted to engage a portion of a substantially vertically oriented pipe.

11. A system for transferring pipe during well drilling operations, the system comprising:

a fingerboard;

a central mounting structure;

a pipe transfer carriage that is movably coupled to said central mounting structure, wherein said pipe transfer carriage is adapted to move a substantially vertically oriented pipe from said fingerboard to a position adjacent to and above a centerline of a well; and first and second pipe engagement jaws that are pivotably connected to said pipe transfer carriage at respective first and second pivotable connections comprising respective first and second angled interfaces between a respective pipe engagement jaw and said pipe transfer carriage, wherein each of said first and second pipe engagement jaws is pivotably rotatable about a respective pivotable connection in a respective first and second angled plane, wherein an angle of each of said first and second angled planes is substantially defined by an angle of a respective first and second angled interface relative to a substantially vertical plane, wherein said first angled plane is different from and oriented at a non-zero angle relative to said second angled plane and substantially mirrors said second angled plane relative to said substantially vertical plane, wherein said first and second pipe engagement jaws are adapted to be pivotably rotated down and together to a closed position so as to cooperatively engage with and support said substantially vertically oriented pipe during said movement of said pipe, and wherein said first and second pipe engagement jaws are further adapted to be pivotably rotated up and apart from said closed position to an open position so as to disengage said first and second pipe engagement jaws from said cooperative supporting engagement with said pipe when said pair of pipe engagement jaws are bumped from below by a drilling rig elevator as said elevator is being raised.

12. The system of claim 11, wherein each one of said first and second pipe engagement jaws are adapted to be pivotably rotated to a substantially horizontal position when said first and second pipe engagement jaws are in said closed position and pivotably rotated to a raised position when said first and second pipe engagement jaws are in said open position.

13. The system of claim 11, wherein said central mounting structure is positioned between opposing first and second pluralities of racking fingers that are adapted to support a plurality of pipes in a substantially vertical orientation.

14. The system of claim 13, further comprising a pair of movable trolleys, wherein each of said pair of movable trolleys is operatively coupled to said central mounting structure and is adapted to move a substantially vertically oriented pipe along a respective opposing side of said central mounting structure from a location adjacent to a pair of racking fingers of one of said first and second pluralities of racking fingers and position said pipe for said cooperative supporting engagement with said first and second pipe engagement jaws.

15. The system of claim 14, wherein each of said pair of movable trolleys comprises a movable cradle that is adapted to rotate a substantially vertically oriented pipe from a position adjacent to a respective one of said opposing sides of said central mounting structure to a position adjacent to one of said first and second pipe engagement jaws.

16. The system of claim 15, further comprising a pair of arcuate pipe positioning arms, wherein each of said pair of arcuate pipe positioning arms is connected to said fingerboard adjacent to a respective one of said opposing sides of said central mounting structure and is adapted to facilitate rotation of a substantially vertically oriented pipe by a respective one of said movable cradles from said position adjacent to said respective one of said opposing sides to said position adjacent to said one of said first and second pipe engagement jaws.

17. The system of claim 16, wherein said pipe transfer carriage is adapted to move a substantially vertically oriented pipe to a position adjacent to and above a centerline of said well by moving said pipe through an opening between respective ends of said pair of arcuate pipe positioning arms.

18. The system of claim 15, wherein each of said movable cradles comprises a gear-toothed end and said central mounting structure comprises a rack positioned on each of said opposing sides thereof, wherein each of said racks is adapted to engage with a gear-toothed end of a respective movable cradle so as to facilitate rotation of said movable cradle.

19. The system of claim 15, wherein each of said movable cradles is adapted to position a substantially vertically oriented pipe adjacent to a first one of said first and second pipe engagement jaws while said first one of said first and second pipe engagement jaws is in a substantially horizontal position and a second one of said first and second pipe engagement jaws is in a raised position relative to said substantially horizontal position.

20. The system of claim 11, further comprising a jaw moving apparatus that is operatively coupled to each one of said first and second pipe engagement jaws, wherein said jaw moving apparatus is adapted to selectively pivotably rotate each respective one of said first and second pipe engagement jaws relative to the other respective one of said first and second pipe engagement jaws.

21. The system of claim 20, wherein said jaw moving apparatus is further adapted to maintain a position of each one of said first and second pipe engagement jaws after said first and second pipe engagement jaws have bumped from below by a drilling rig elevator and said first and second pipe engagement jaws have been pivotably rotated and raised from said closed position to said open position.

22. A system for transferring pipe during well drilling operations, the system comprising:

a fingerboard comprising a central mounting structure and first and second pluralities of racking fingers positioned adjacent to respective first and second opposing sides of said central mounting structure, wherein each of said first and second pluralities of racking fingers are adapted to support a plurality of pipes in a substantially vertical orientation;

a pipe transfer carriage that is movably coupled to said fingerboard, wherein said pipe transfer carriage is adapted to move a substantially vertically oriented pipe from said fingerboard to a position adjacent to and above a centerline of a well;

first and second pipe engagement jaws that are pivotably connected to said pipe transfer carriage at respective first and second pivotable connections comprising respective first and second angled interfaces between a respective pipe engagement jaw and said pipe transfer carriage, wherein each of said first and second pipe engagement jaws is pivotably rotatable about a respective pivotable connection in a respective first and second angled plane, wherein an angle of each of said first and second angled planes is substantially defined by an angle of a respective first and second angled interface relative to a substantially vertical plane, wherein said first angled plane substantially mirrors said second angled plane relative to said substantially vertical plane, wherein said first and second pipe engagement jaws are adapted to be pivotably rotated down and together to a closed position so as to cooperatively engage with and support said substantially vertically oriented pipe during said movement of said pipe, and wherein said first and second pipe engagement jaws are further adapted to be pivotably rotated up and apart from said closed position to an open position so as to disengage said first and second pipe engagement jaws from said cooperative supporting engagement with said pipe when said pair of pipe engagement jaws are bumped from below by a drilling rig elevator as said elevator is being raised;

first and second movable trolleys operatively coupled to said respective first and second opposing sides of said central mounting structure, wherein each of said first and second movable trolleys comprises a movable cradle that is adapted to rotate a substantially vertically oriented pipe from a position adjacent to a respective one of said first and second opposing sides to a position adjacent to one of said first and second pipe engagement jaws; and first and second arcuate pipe positioning arms connected to said fingerboard and positioned adjacent to a respective one of said opposing sides, wherein each of said first and second arcuate pipe positioning arms is adapted to facilitate rotation of a substantially vertically oriented pipe by a respective one of said movable cradles from said position adjacent to said respective one of said first and second opposing sides to said position adjacent to said one of said first and second pipe engagement jaws.

23. A system for transferring pipe during well drilling operations, the system comprising:

a fingerboard comprising a central mounting structure and first and second pluralities of racking fingers positioned adjacent to respective first and second opposing sides of said central mounting structure, wherein said central mounting structure comprises a rack positioned on each of said first and second opposing sides and each of said first and second pluralities of racking fingers are adapted to support a plurality of pipes in a substantially vertical orientation;

a pipe transfer carriage that is movably mounted to said central mounting structure, said pipe transfer carriage being adapted to move a substantially vertically oriented pipe from said fingerboard to a position adjacent to and above a centerline of a well;

first and second pipe engagement jaws that are pivotably connected to said pipe transfer carriage at respective first and second pivotable connections comprising respective first and second angled interfaces between a respective pipe engagement jaw and said pipe transfer carriage, wherein each of said first and second pipe engagement jaws is pivotably rotatable about a respective pivotable connection in a respective first and second angled plane, wherein an angle of each of said first and second angled planes is substantially defined by an angle of a respective first and second angled interface relative to a substantially vertical plane, wherein said first angled plane substantially mirrors said second angled plane relative to said substantially vertical plane, wherein said first and second pipe engagement jaws are adapted to be pivotably rotated down and together to a closed position so as to cooperatively engage with and support said substantially vertically oriented pipe during said movement of said pipe, and wherein said first and second pipe engagement jaws are further adapted to be pivotably rotated up and apart from said closed position to an open position so as to disengage said first and second pipe engagement jaws from said cooperative supporting engagement with said pipe when said pair of pipe engagement jaws are bumped from below by a drilling rig elevator as said elevator is being raised; and first and second movable trolleys operatively coupled to said respective first and second opposing sides of said central mounting structure, each of said first and second movable trolleys comprising a movable cradle having a gear-toothed end that is adapted to engage with a respective one of said racks positioned on said first and second opposing sides of said central mounting structure, wherein each of said respective movable cradles is adapted to rotate said substantially vertically oriented pipe from a position adjacent to a respective one of said opposing sides of said central mounting structure to a position adjacent to one of said first and second pipe engagement jaws during engagement of a respective gear-toothed end with a respective rack.

* * * * *